US010364072B2

(12) United States Patent
Tebbe et al.

(10) Patent No.: US 10,364,072 B2
(45) Date of Patent: Jul. 30, 2019

(54) SPILL PROOF CONTAINER

(71) Applicant: Munchkin, Inc., Van Nuys, CA (US)

(72) Inventors: Mark Gerard Tebbe, Ventura, CA (US); Agnes Yena Lee, Los Angeles, CA (US); Sung Yun Chan, Pasadena, CA (US)

(73) Assignee: Munchkin, Inc., Van Nuys, CA (US)

( * ) Notice: Subject to any disclaimer, the term of this patent is extended or adjusted under 35 U.S.C. 154(b) by 95 days.

(21) Appl. No.: 15/415,826

(22) Filed: Jan. 25, 2017

(65) Prior Publication Data

US 2017/0210516 A1 Jul. 27, 2017

Related U.S. Application Data

(60) Provisional application No. 62/402,888, filed on Sep. 30, 2016, provisional application No. 62/287,368, filed on Jan. 26, 2016, provisional application No. 62/287,117, filed on Jan. 26, 2016.

(51) Int. Cl.

| | |
|---|---|
| ***B65D 43/16*** | (2006.01) |
| ***A47G 19/30*** | (2006.01) |
| ***B65D 23/10*** | (2006.01) |
| ***B65D 55/16*** | (2006.01) |

(52) U.S. Cl.

CPC ..... *B65D 43/166* (2013.01); *A47G 19/30* (2013.01); *B65D 23/104* (2013.01); *B65D 55/16* (2013.01); *B65D 2251/0018* (2013.01); *B65D 2251/0093* (2013.01); *B65D 2543/00564* (2013.01); *B65D 2543/00833* (2013.01); *B65D 2543/00842* (2013.01)

(58) Field of Classification Search

CPC ..... A47J 47/02; B65D 47/06; A47G 19/30

See application file for complete search history.

(56) References Cited

U.S. PATENT DOCUMENTS

| | | | | |
|---|---|---|---|---|
| 4,600,112 | A | 7/1986 | Shillington et al. | |
| 4,884,717 | A | 12/1989 | Bussard | |
| 5,653,353 | A | 5/1997 | Otto et al. | |
| 8,245,870 | B2 | 8/2012 | McKinney et al. | |
| 2005/0252923 | A1 | 11/2005 | Woolf | |
| 2009/0223969 | A1 | 9/2009 | Bouie | |
| 2011/0135222 | A1 | 6/2011 | Krueger et al. | |
| 2013/0098933 | A1* | 4/2013 | Del Solar | A47J 47/02 220/810 |
| 2013/0306667 | A1 | 11/2013 | Chan | |

FOREIGN PATENT DOCUMENTS

| | | |
|---|---|---|
| KR | 101475277 | 12/2014 |

OTHER PUBLICATIONS

International Search Report arid Written Opinion for PCT/US17/15074. dated Jan. 26, 2017. (22 Pages).

International Written Opinion for PCT/US2017/015074, dated Aug. 9, 2018. (pp. 10).

* cited by examiner

*Primary Examiner* — Andrew T Kirsch

(74) *Attorney, Agent, or Firm* — Robert Z. Evora, Esq.

(57) ABSTRACT

A spill proof container assembly having a receptacle, a non spill barrier, a collar with a hook, a handle and a cover. The cover has in integrated hinge strap disposed at a peripheral edge. The hinge strap has a first surface having a curved notch and a second surface with a raised bump. When the hinge strap is attached to the hook, the cover pivots between an open position and closed position.

14 Claims, 10 Drawing Sheets

SPILL PROOF CONTAINER

CROSS REFERENCE TO RELATED APPLICATION

This application claims priority to U.S. Provisional Patent Application Ser. No. 62/287,117, filed Jan. 26, 2016, U.S. Provisional Patent Application Ser. No. 62/287,368, filed Jan. 26, 2016, and U.S. Provisional Patent Application Ser. No. 62/402,888, filed Sep. 30, 2016; the contents of which are hereby incorporated by reference herein in their entirety into this disclosure.

TECHNICAL FIELD

The subject disclosure relates generally to food or small item containers and, more particularly, to an anti-spill container for food or other small items.

BACKGROUND

Various small food goods, generally consumed between regular meals, are often packaged in disposable cartons or plastic bags. As opposed to carrying the larger box, the small construction of an individual serving size is convenient during a snack time when the person is not sitting at a table using conventional tableware. Unfortunately, not eating at a table frequently leads to spilling of some of the food upon the individual eating and/or on the floor. Especially, when a small infant learns to feed themselves, they frequently spill food from containers and create a mess. Traditionally, removable lids have also been added; however, once the lid is removed they are frequently lost, misplaced and/or difficult to relocate. Unfortunately, this deficiency has never been addressed previously.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of the present invention will now be described in greater detail with reference to the figures.

Figure 1:
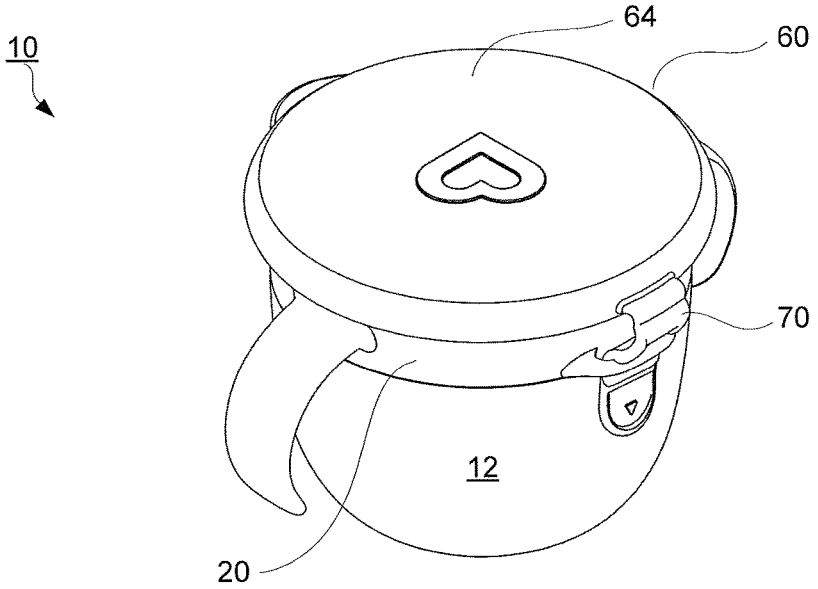
FIG. 1 illustrates an exemplary container assembly according to the subject disclosure.

FIG. 1 illustrates an embodiment for a spill proof container assembly 10 in a closed position. The container assembly 10 includes a receptacle 12 with a collar assembly 20 and a cover 60 having a detachable hinge strap 70.

Figure 2:
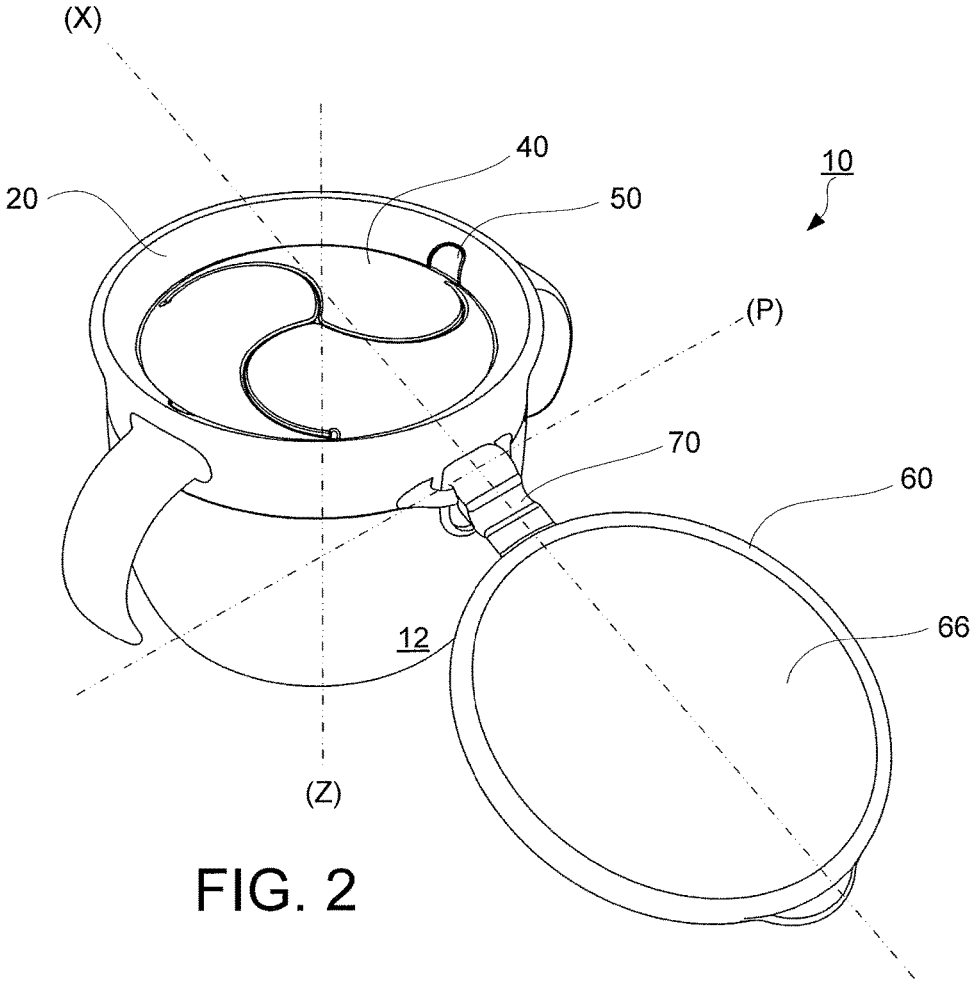
FIG. 2 is a perspective view of the container assembly in an open position.

FIG. 2 illustrates the spill proof container assembly 10 in an open position. Various small items can be used with the spill proof container assembly 10, including but not limited to for example, crackers, cookies, chopped fruits and vegetables, popcorn, shelled nuts, potato chips, dry cereal, candies, raisins, other snack items or other relative small items such as tools, nuts, bolts, buttons, etc.

Figure 3:
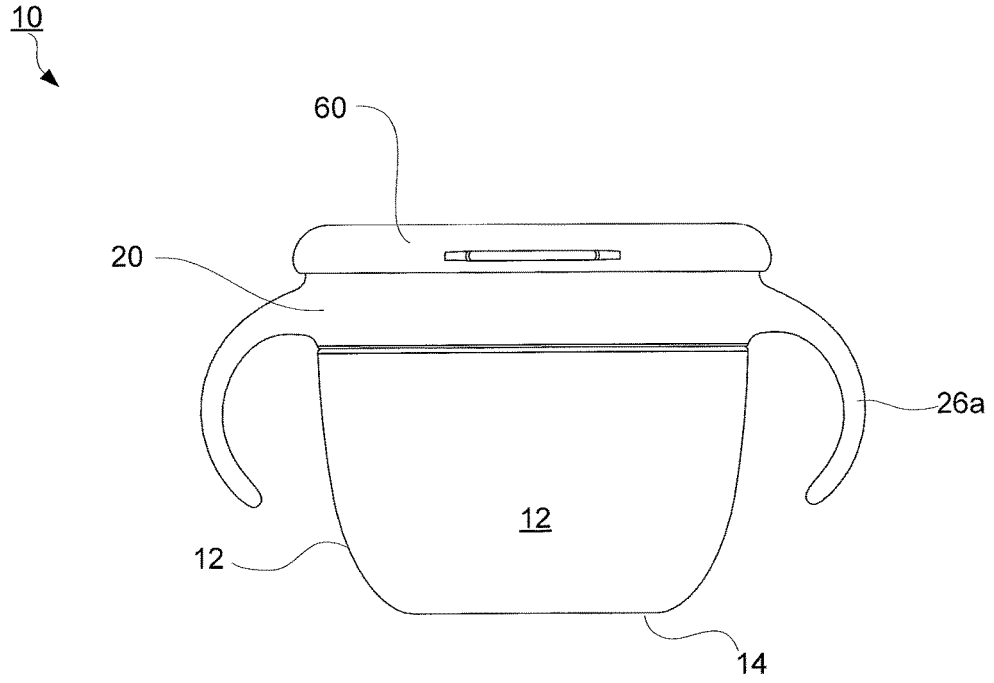
FIG. 3 is a front view of the container assembly.
Figure 4:
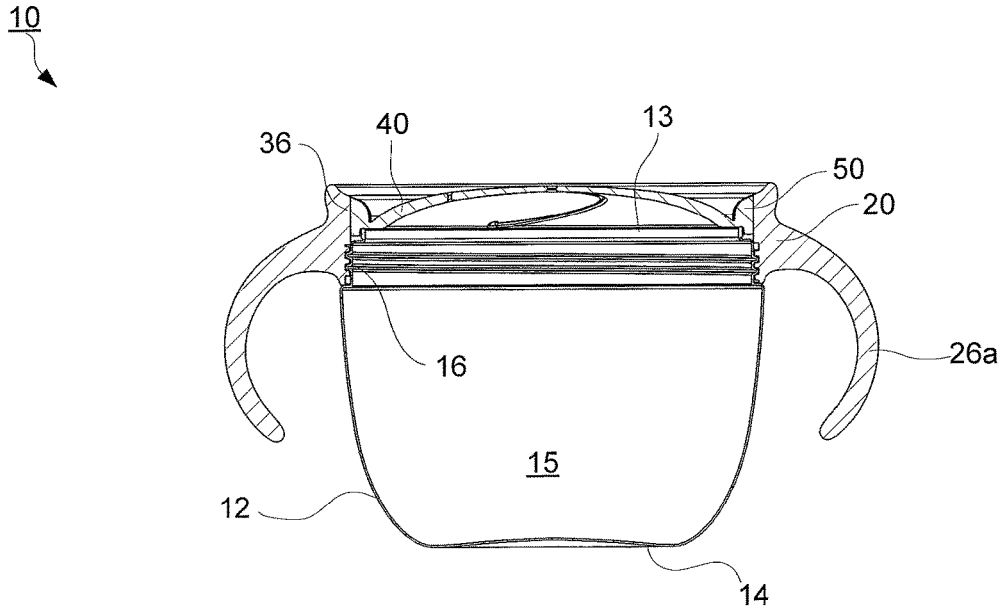
FIG. 4 is a cross sectional view of the container assembly.

FIGS. 3 and 4 show a front view and a cross sectional view of the container assembly 10. The receptacle 12 includes an interior chamber 15 defined by an open top 13 and a closed bottom 14. The container assembly 10 is generally cylindrical in shape. However, it is to be understood that the container assembly 10 may take any preferred shape. The interior chamber 15 of receptacle 12 is adapted to receive various items.

Figure 5:
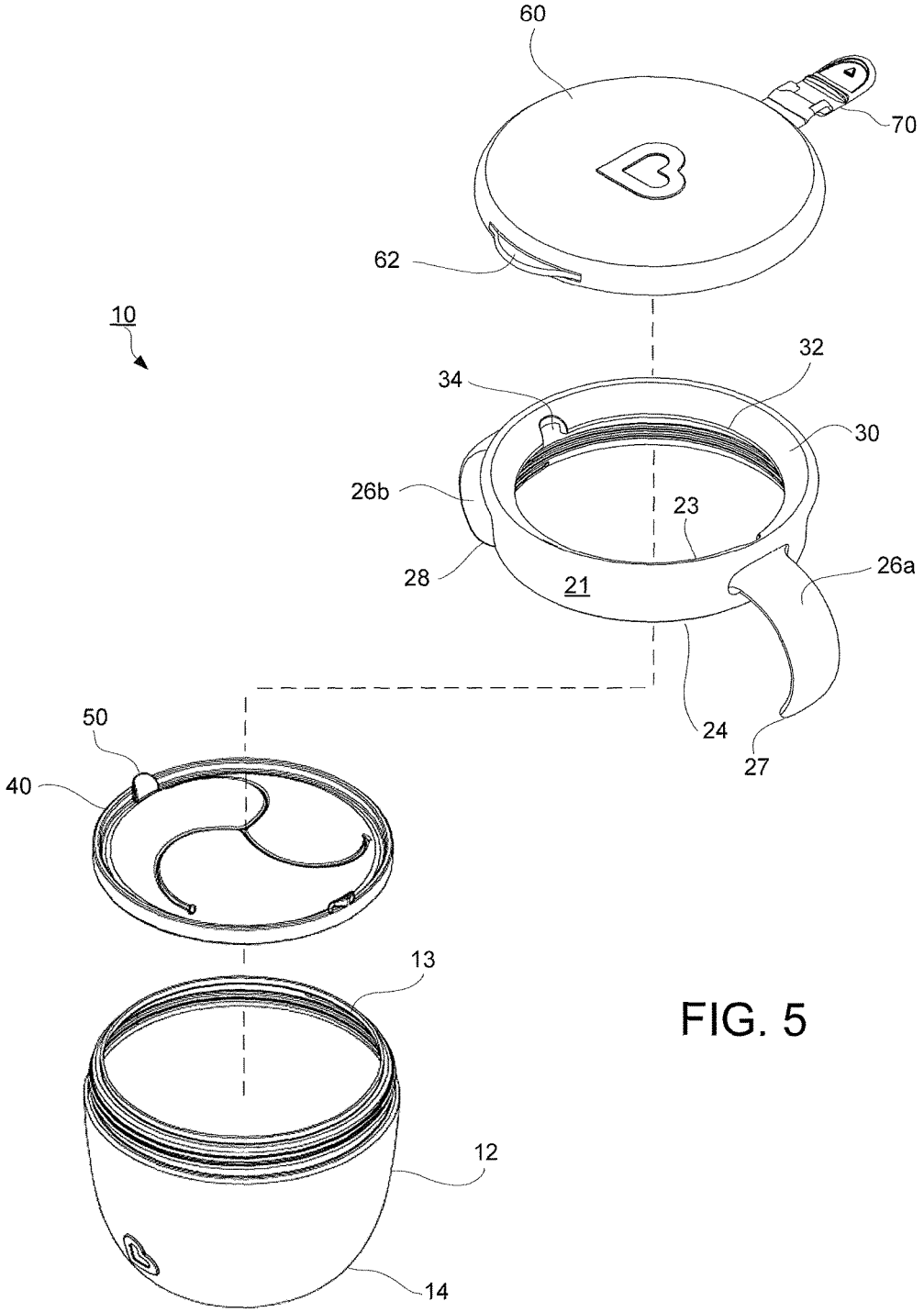
FIG. 5 is an exploded view of the container assembly.

FIG. 5 shows an exploded view of the container assembly 10. The container assembly 10 is preferably made of a resilient unbreakable material, such as plastic, and may be either opaque or transparent. The receptacle 12 may be composed of a semi rigid or rigid cup made preferably of a transparent plastic so as to permit viewing of the food item contained therein. In another embodiment, the receptacle 12 may be insulated or made of food grade stainless steel to help regulate the temperature of the contents therein. The container assembly 10 may take any number of different sizes and shapes, such as cylindrical or frusto-conical shaped side walls, a circular flat bottom 14 and/or any other suitable shape in accordance with the present disclosure.

The collar assembly 20 is secured on top of the receptacle 12 by a threaded fastener 16, as shown in FIG. 4. However, it is understood that the collar assembly 20 may be attached to the receptacle 12 with a snap-fit construction and/or any suitable method used to detachably secure the collar assembly 20 to the receptacle 12.

The collar assembly 20 includes a collar 21 and a non spill barrier or diaphragm 40 that can be detached from the collar 21 as shown in FIG. 5. The collar 21 has integrated handles 26*a*, 26*b* extending from an exterior midpoint 22 between a top edge 23 and bottom edge 24 of the collar 21. The first handle 26*a* has a downward curved shaped and extends to a free end 27 to allow for grippability. As shown in figures FIGS. 6 and 7, the collar 21 further includes an integrated second handle 26*b* having a second free end 28 located substantially opposite from the first handle 26*a*.

Figure 6:
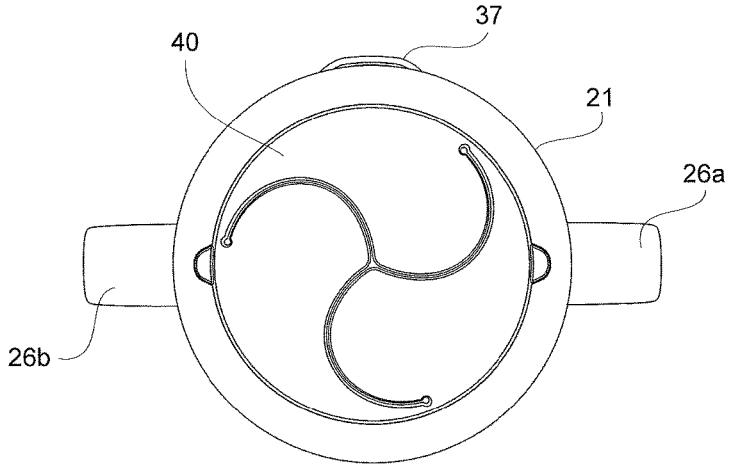
FIG. 6 is a top view of the container assembly without a cover.
Figure 7:
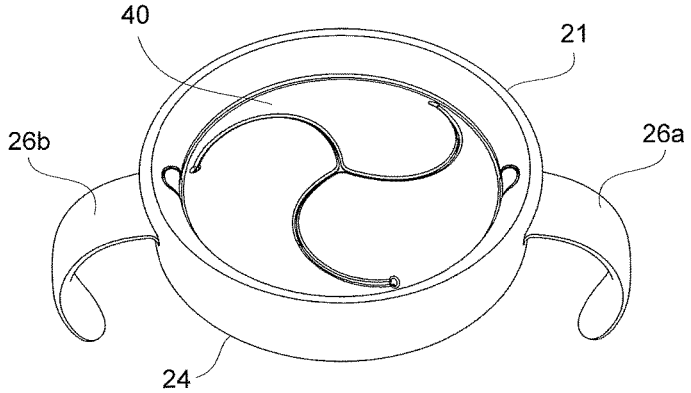
FIG. 7 is an isolated perspective view of a collar assembly.
Figure 8:
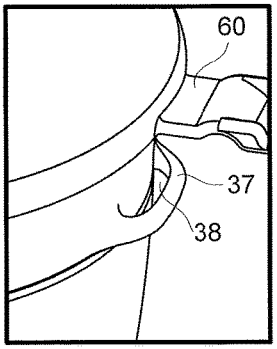
FIG. 8 is an enlarged cut out view of the container assembly.

FIGS. 6 and 8 depict a hook 37 attached to the exterior surface of the collar 21. The hook 37 includes on opening 38 that receives the hinge strap 70, discussed below. The opening 38 is constructed such that the width and length is substantially the same as the dimensions of the hinge strap 70. As shown in FIG. 8, the hook 37 may be located at or near the bottom edge 24 of the collar 21 and may be positioned between the handle 24 and the second handle 26. However, it is to be understood that the hook 37 may be attached at any location on the exterior surface of the collar 21 or the receptacle 12.

Referring back to FIG. 5, the collar 21 also includes a collar flange 30 that extends concentrically inward and downward towards the open top 13 of the receptacle 12. As seen from the perspective view, at least one recess 34 extends from a downward portion 32 of the collar flange 30 that matingly fits with a guide or positioning tab 50 discussed below.

Figure 9:
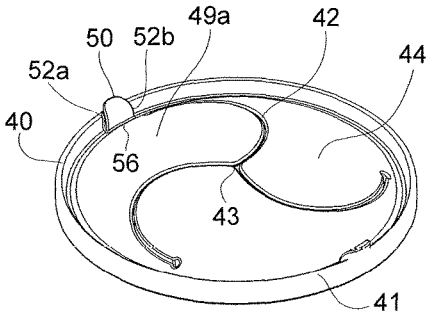
FIG. 9 is an isolated upper perspective view of a non spill barrier.
Figure 10:
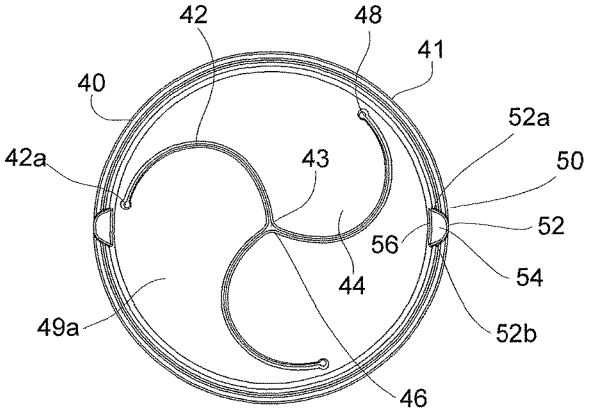
FIG. 10 is a top view of FIG. 9.
Figure 11:
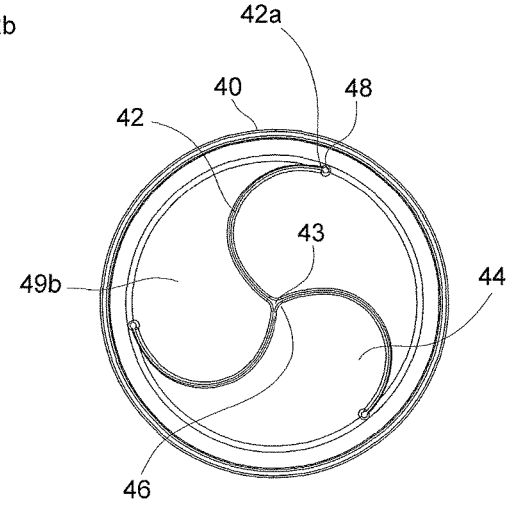
FIG. 11 is a bottom view of FIG. 10.

The collar assembly 20 also includes a non spill barrier or diaphragm 40 that extends across and covers the open top 13 of the receptacle 12. The diaphragm 40 may be constructed flat, being molded of a flexible rubber, a stamped resilient plastic, and/or any other suitable flexible material as shown in FIGS. 9 through 11. The flexible non-spill barrier or diaphragm 40 may be constructed to be fixedly attached or removable from the collar 21. In use, the diaphragm 40 is positioned between the open top 13 and the collar flange 30.

FIGS. 9, 10, and 11 show an isolated upper perspective view, a top view, and a bottom view of the diaphragm 40 respectively. The diaphragm 40 includes a plurality of openings or crossing slits 42 extending radially outwards and in a curved configuration from a center 43 towards a peripheral rim 41 of the diaphragm 40 adjacent to the downward portion 32 (as shown in FIG. 5) of the collar flange 30 (see FIGS. 6 and 7) to form a circular row of tongues or flaps 44 there between. A plurality of raised lips or ribs 48 surrounds an end 42*a* of the crossing slits 42 at a top surface 49*a* and bottom surface 49*b* of the diaphragm 40. These ribs 48 provide extra reinforcement to the ends 42*a* of the crossing slits 42 and prevent the flaps 44 from tearing open on the diaphragm 40. As shown in FIGS. 9 through 11, the raised ribs 18 are circular but may take on any other shape such as zigzag, rectangular, or the like consistent with the subject disclosure herein.

Figure 12:
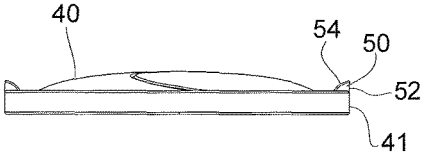
FIG. 12 is a side view of FIG. 10.

Additionally, pointed ends 46 of the flaps 44 abut each other at the center 43 of the diaphragm 40, as shown in FIG. 12. At rest, the flaps 44 close the interior chamber 15 of the receptacle 12 to retain the food or contents therein. In another embodiment, the flaps 44 may be constructed to overlap one another to provide extra closure and to retain the contents stored therein.

As shown in FIGS. 9 and 10, the diaphragm 40 may be provided with at least one guide or positioning tab 50 disposed at a peripheral edge 41 of the diaphragm 40. The tab 50 may be formed integrally with the flexible diaphragm 40, or as two separate components. Referring to FIG. 12, the tab 50 includes a tab wall 52 extending from the peripheral edge 41. The tab wall 52 is substantially flush with the outer surface of the peripheral edge 41 at its highest point.

Additionally, the tab wall 52 borders a tab ramp 54. The tab wall 52 extends along the edges of tab ramp 54 having a first surface 52*a* and a second surface 52*b* as shown in FIG. 10. Both the first surface 52*a* and second surface 52*b* start at the tab wall 52 and extend curvingly downward from an upper end of 54 to a lower end of 54 defining an inner edge 56. From a top view, shown in FIG. 10, the tab ramp 54 is U-shaped or C-shaped and configured to matingly fit within the recess 34 (shown in FIG. 5).

When the diaphragm 40 is inserted underneath the collar flange 30, the tab 50 sits within the recess 34 and the diaphragm 40 is trapped in between the downward portion 32 of the collar flange 30 and an inner wall 36 of the collar 21 (see FIGS. 4 and 5). Additionally, the surface of the tab ramp 54 lies flush with the collar flange 30 to create a smooth exterior or seamless integration between the diaphragm 40 and collar 21. As a result, the positioning tab 50 is locked into the recess 34 and the diaphragm 40 will not twist or become misaligned and is sufficiently secured to prevent its removal by a young child, or the like. However, the diaphragm 40 may be removed for cleaning purposes.

The diaphragm 40 may be constructed of a flexible material that will not scratch or otherwise injure a hand inserted through the flexible flaps 44 of the diaphragm 40 allows the interior chamber 15 of receptacle 12 to grab and withdraw contents from within the receptacle 12. Also, the flexible material of the diaphragm 40 will allow the hand inserted through the flaps 44 to extricate easily and safely without scratching or otherwise injuring the hand. Once the hand is removed from the receptacle 12, the flaps 43 of the diaphragm 40 return to their original position covering the open top 13 of the receptacle 12. It is to be noted that the diaphragm 40 may also be constructed of a transparent material. Likewise, the diaphragm 40 may be of a one-piece construction with the cover 60.

The flexible diaphragm 40 may be formed of a variety of different materials, including but not limited to a durometer, such as a range of between 65-95, using for example, standard test method ASTM D 2240, and a tear strength of greater than 200 lb/in, using standard test method ASTM D-1044 and/or any other suitable material capable of retaining the shape memory of the plastic material to ensure that the flaps 44 of the diaphragm 40 will return to their original position despite multiple deflections of flaps by one inserting their hand there-through.

Various materials, for example, may include but is not limited to thermoplastic polyurethane (TPU) or thermoplastic polyesters (TPE), polyolefin Elastomers (POE). Other commercially available materials may include Engage, Sarlink, Texin, Desmopan, Dynaflex, Versalloy, Versaflex, and Elastolan and/or other suitable material according to this subject disclosure. It should be noted that some or all of the above commercially available materials may be trademarks of the companies' manufacturing and/or selling the materials.

Figure 13:
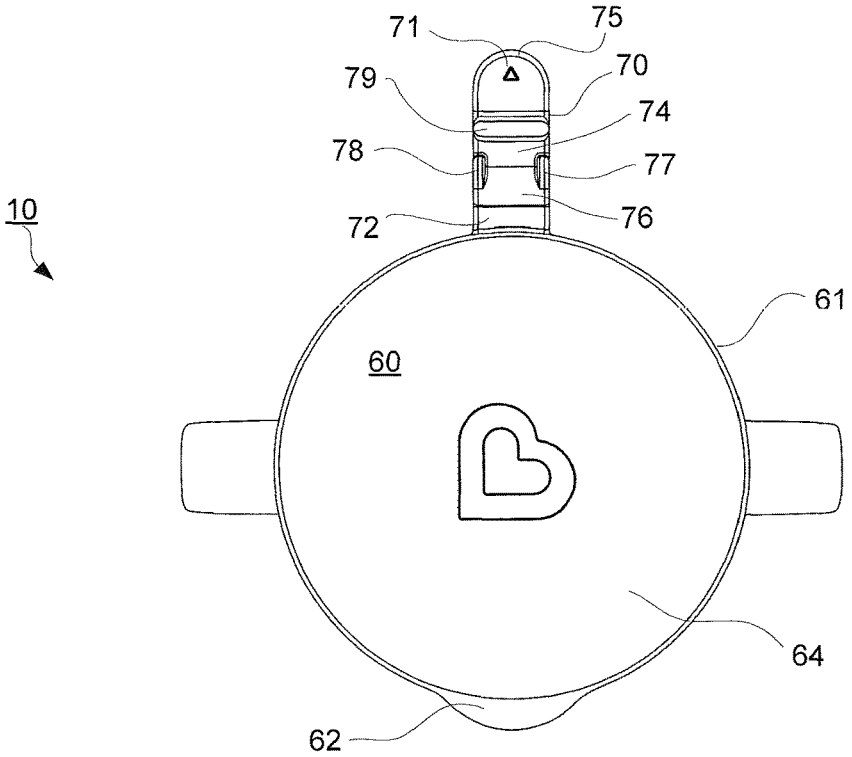
FIG. 13 is another top view of the container assembly with a hinge strap detached.
Figure 14:
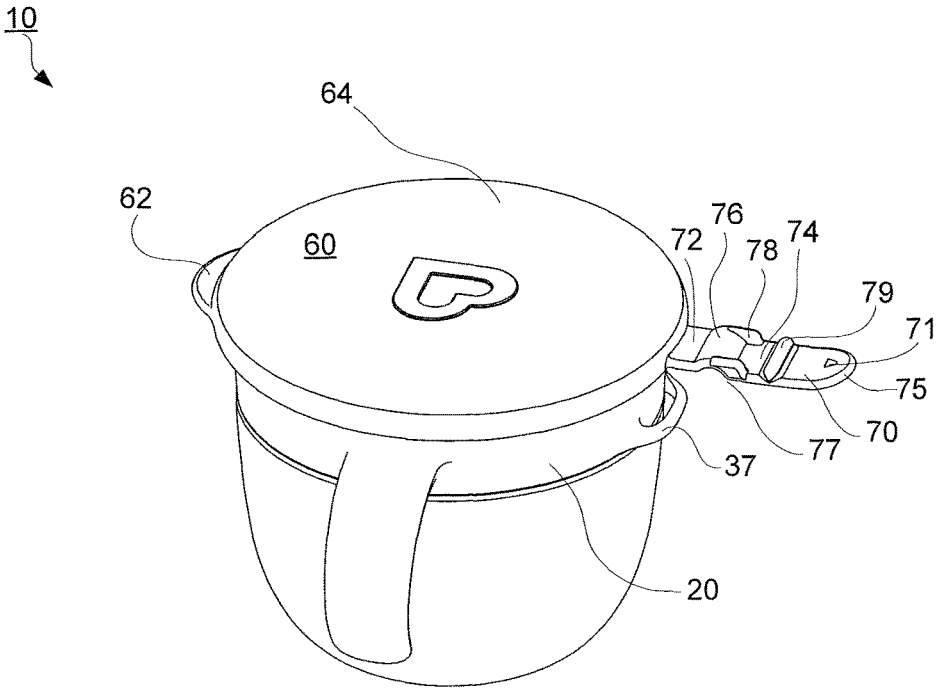
FIG. 14 is a perspective view of FIG. 1 with the hinge strap detached.

FIGS. 13 and 14 show a top view and perspective view of the container assembly 10 in a closed position but with the detachable hinge strap 70 unhooked from the collar assembly 20. The cover 60 sits above the collar assembly 20 via a friction and snap-fit construction, as shown in FIG. 14. The cover has a front surface 64 and a back surface 66 (see FIG. 2). The cover 70 is generally cylindrical but can take on any shape consistent with the container assembly 10. Additionally, the cover 60 may be made of silicon, rubber, or the like.

Located on opposite ends of a cover's peripheral edge 61 are a pull tab 62 and the detachable hinge strap 70. Both of the pull tab 62 and the detachable hinge strap 70 are integrated with the cover 60 and preferably made of the same material as the cover 60. However, the cover 60, the pull tab 62 and the hinge strap 70 can be constructed as separate pieces made up of different materials. The pull tab 62 provides additional assistance to easily lift the cover 60 from the collar assembly 20 when the container assembly 10 is in the closed position.

The hinge strap 70 extends outward from the cover's peripheral edge 61 to a predetermined distance, D. When the hinge strap 70 is detached from the hook 37, the hinge strap 70 suspends freely in a substantial horizontal position, in a plane in which the lid 60 lies. The hinge strap 70 suspends similarly to a spring board or a diving board as shown in FIG. 14. Starting from the cover's peripheral edge 61, the hinge strap 70 includes a first surface or platform 72 attached to a curved notch 76 that descends to meet a second surface or platform 74 with a free end 75. A first balancing rib 77 and a second balancing rib 78 are constructed at the intersection between where the curved notch 76 ends and the second platform 74 begins. Located on the second platform 74 is a raised bump 79 that is spaced at a predetermined distance from the balancing ribs 77 and 78. The distance between the raised bump 79 and the balancing ribs 77 and 78 is substantially equal to and constructed to receive the thickness of the hook 37.

In other words, as shown if FIGS. 1 and 2, when the hinge strap 70 is secured to the hook 37, in a closed position, the back surface 66 of the cover 60 faces downward into the closed end of the receptacle 12 and the front surface 64 faces outward and away from the closed end of the receptacle 12. Additionally, when the cover 60 is opened, the back surface 66 of the cover pivots, along axis (P), adjacent to the hook 37 radially open and away from the back surface 66 facing the closed end of the receptacle 12 outward along a rotation plane (XZ) such that when the cover 60 is in an open position, the back surface 66 faces outward and radially away from the closed end and the receptacle 12. As a result, the front surface 64 faces inward toward the receptacle 12.

Figure 15:
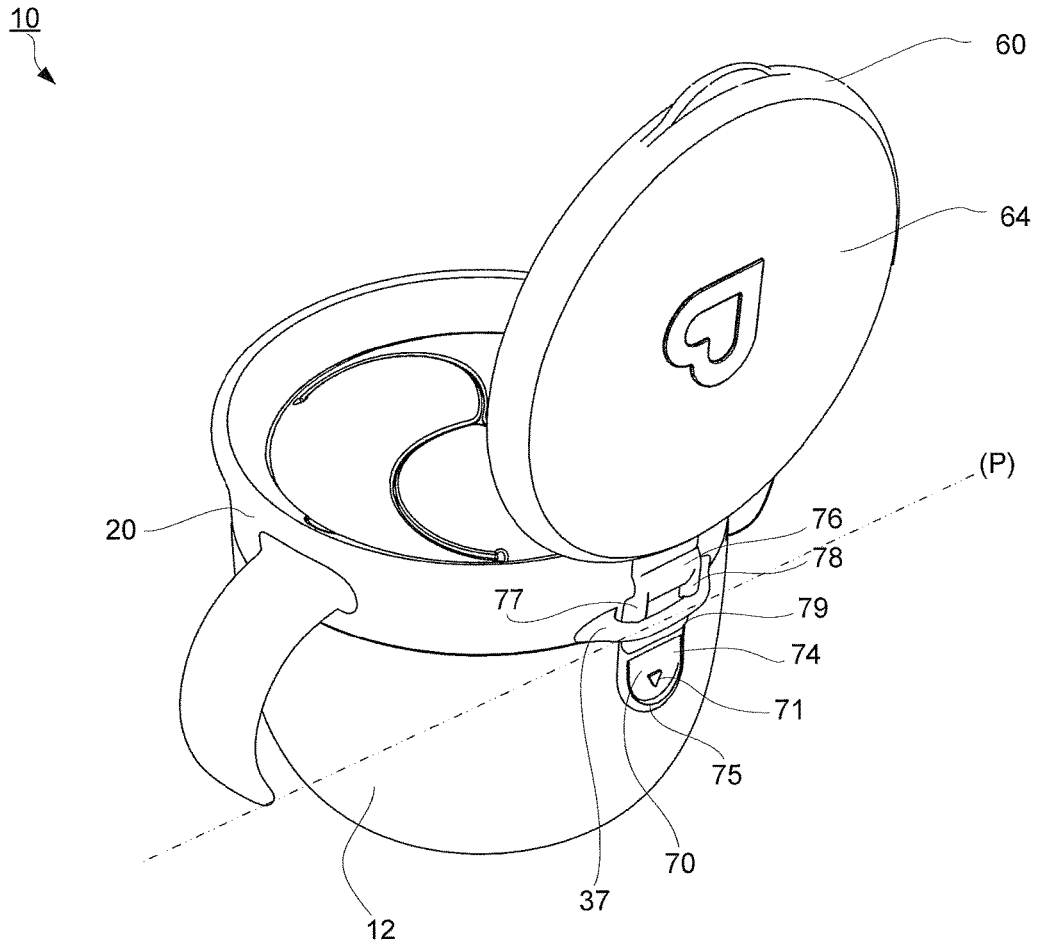
FIG. 15 is a perspective view of FIG. 2 with the cover partially open.

FIG. 15 shows the hinge strap 70 attached to the hook 37. Adjacent to the free end 75 and located on the second platform 74 is a directional mark 71. During the hinge strap 70 installation, the directional mark 71 guides a user to insert the free end 75 through the opening 38 of the hook 37. The second platform 74 is then pulled through the hook 37 until the raised bump 79 passes the hook 37 and the hook 37 is trapped securely in between the balancing ribs 77, 78 and the raised bump 79. Once the hinge strap 70 is securely fastened to the hook 37, the combination of the curved notch 76 along with the balancing ribs 77 and 78 provide both the rigidity and bias or spring-like mechanism of the hinge strap 70. As a result of this construction for the hinge strap 70, the cover 60 more easily springs up and down during removal of the cover 60 from the collar assembly 20. Likewise, the configuration of the hinge strap 70 is more rigid thereby preventing an uneven tilting of the cover 60 or substantial twisting of the cover along an axial length of the strap disposed orthogonal to the pivot axis (P).

Figure 16:
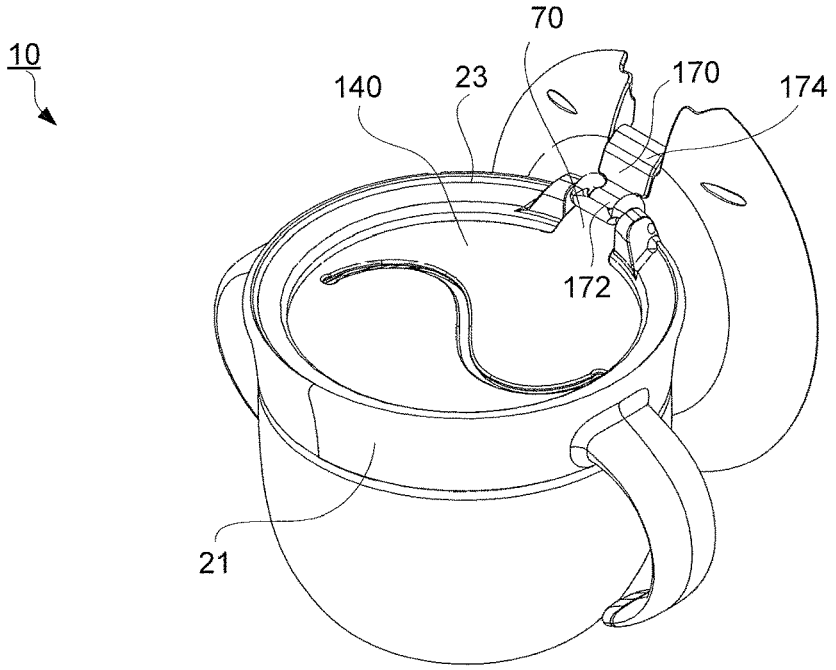
FIG. 16 is another embodiment of the container assembly in an open position.
Figure 17:
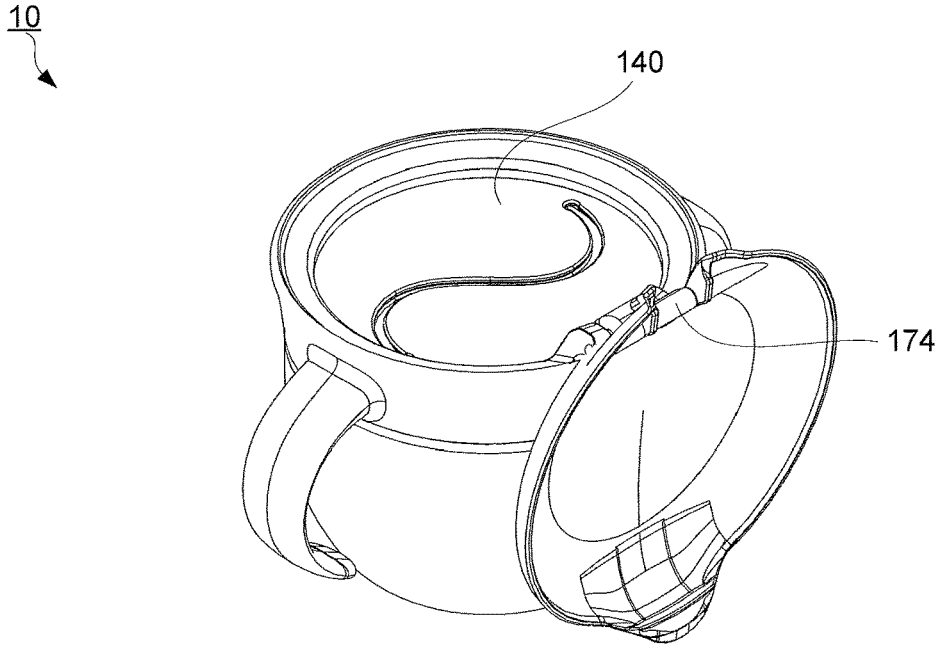
FIG. 17 is a perspective view of FIG. 16 rotated clockwise at or about 90 degrees.

FIGS. 16 through 21 illustrate another embodiment of the container assembly 10. In this embodiment, the container assembly 10 includes an overlapping diaphragm 140 and a double hinge assembly 170. The diaphragm 140 has an integrated hinge strap 70 that extends outward and curls inward around a first hinge 172 to create a first pivot end 173 (see FIG. 20). As shown in FIG. 16, the first hinge 172 extends from the top edge 23 of the collar 21. When the cover 60 is open, the combination of the hinge strap 70 secured onto the first hinge 172 creates a bias such that the cover 60 swings open about the first pivot end 173.

Additionally, a second hinge 174 located at the cover 60 swings about a second pivot end 175. As a result, when the cover 60 is open, the second hinge 174 engages the second pivot end 175 and rotates the cover substantially to a vertical position.

Figure 18:
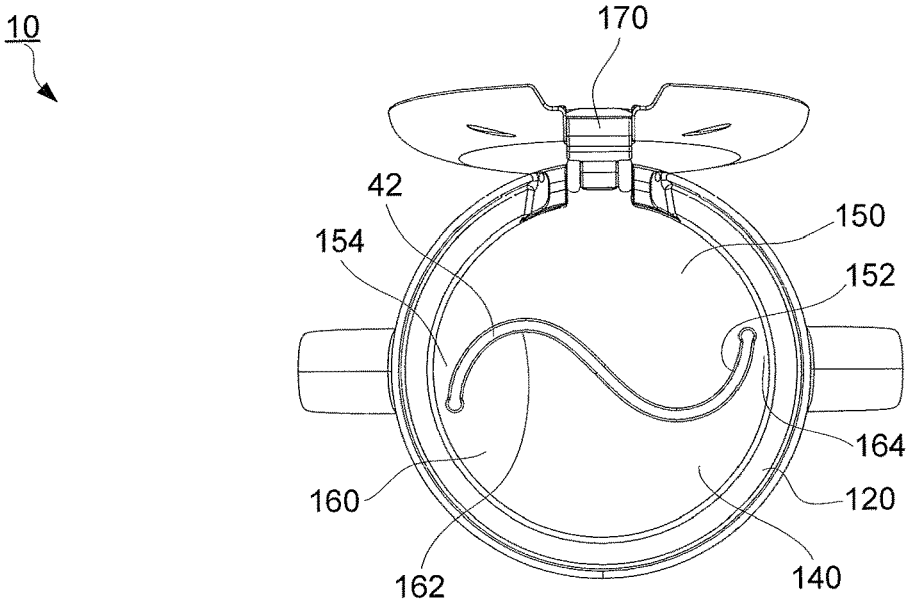
FIG. 18 is a top view of FIG. 16.

FIG. 18 shows a top view of the container assembly 10 with the double hinge assembly 170. This view illustrates the collar assembly 120 having the overlapping diaphragm 140 contoured in an S-shaped slit 42 extending across the diaphragm 140 to bifurcate it into a first portion 150 and a second portion 160. The first portion 150 includes a first rounded flap 152 that slightly descends in width towards a first tail 154. The second portion 160 also includes a second rounded flap 162 that slightly descends in width towards a second tail 164. Referring back to FIGS. 16 and 17, when the first portion 150 and the second portion 160 abut up against each other, the first rounded flap 152 will overlap the second tail 164. Similarly the second rounded flap 162 will overlap the first tail 154. As a result, the diaphragm 140 provides extra sealing for its closure.

Figure 19:
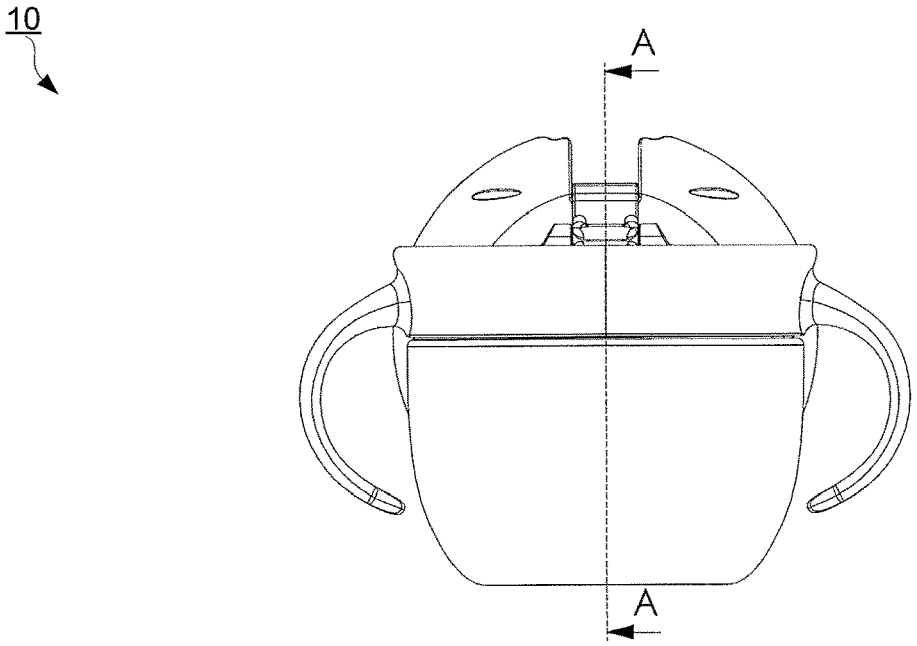
FIG. 19 is a front view of FIG. 16.
Figure 20:
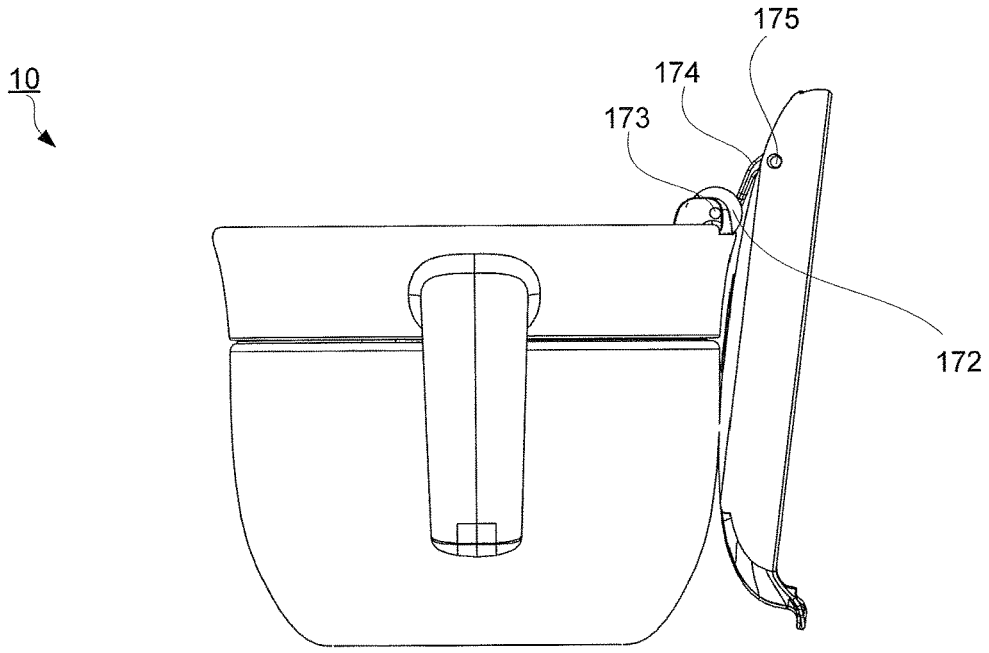
FIG. 20 is a side view of FIG. 16.
Figure 21:
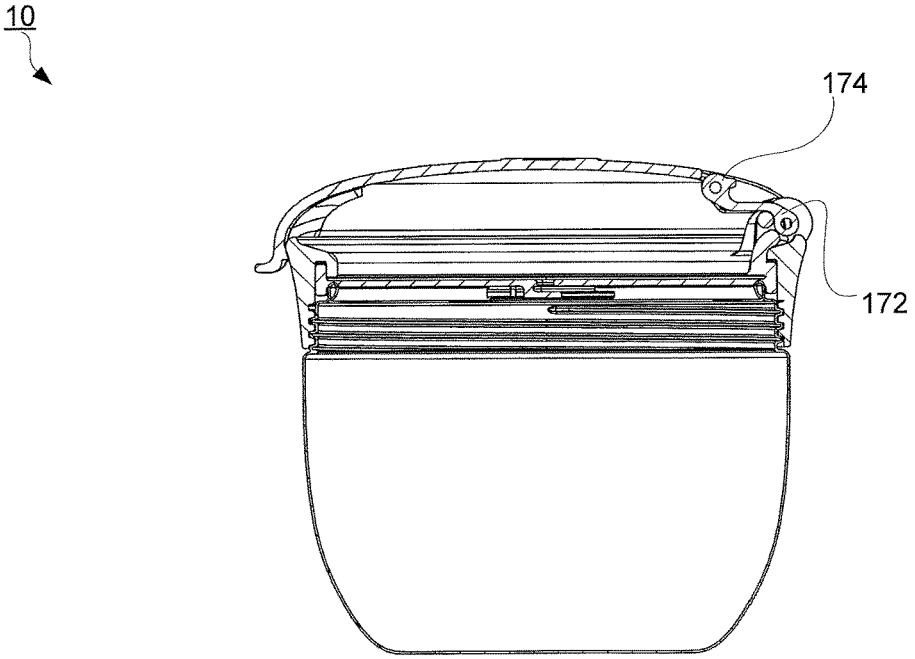
FIG. 21 is a sectional view of FIG. 16.

FIGS. 19, 20 and 21 show a front view, a side view and sectional view of the container assembly 10 with the double hinge assembly 170. As shown, the container assembly 10 is generally cylindrical in shape. However, it is to be understood that the container assembly 100 may take any preferred shape.

Although the container assembly 10 has been described as an anti-spill container assembly for snack food, it will be understood that the container assembly 10 has a variety of other uses. For example, container assembly 10 could also be used as a container for small non-food items, such as a jewelry container, a coin change container, a small hardware parts container assembly and/or any other suitable use for carrying and preventing the spillage of various items. As such, the anti-spill container assembly may be implemented in a virtually unlimited number of different applications.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

What is claimed:

1. A spill proof container assembly comprising: a receptacle having a closed end and an open end; a collar assembly attached to the open end, the collar assembly having a hook; and a cover positioned over the collar assembly, wherein the cover has an integral hinge strap that extends from a peripheral edge of the cover and is adapted to be removably secured to the hook, the hinge strap includes a first surface extending away from the peripheral edge, the first surface having a curved notch that separates a second surface, the first surface is bordered by a first rib and a second rib at opposite sides, located approximately at the intersection between where the curved notch ends and the second surface begins, the second surface has a raised bump adjacent to a free end, wherein when the hinge strap is being secured to the hook, the raised bump of the second surface passes through an opening in the hook until the hook is locked up against the first rib and second rib, and the raised bump, wherein when the hinge strap is secured to the hook, in a closed position, a back surface of the lid faces downward into the closed end of the receptacle and front surface faces outward and away from the closed end of the receptacle, wherein when the lid is opened, the back surface of the lid pivots adjacent to the hook radially open and away from the previous closed position of the back surface, in which the back surface was facing the closed end of the receptacle, outward along a rotation plane such that when the lid is in an open position, the back surface faces outward and radially away from the closed end and the receptacle, and the front surface faces inward toward the receptacle, and wherein the hinge strap is rigid enough to prevent substantial twisting along an axial length of the strap disposed orthogonal to the pivot axis.

2. The spill proof container assembly recited in claim 1, wherein the hinge strap freely suspends outward when it is removed from the hook.

3. The spill proof container assembly recited in claim 1, wherein the open end on the receptacle has a first threaded fastener that matingly attaches to a second threaded fastener on the collar assembly.

4. The spill proof container assembly recited in claim 1, wherein the collar assembly further comprises:

a collar having an exterior surface and an inner wall; and a non-spill barrier disposed underneath the collar and above the open end of the receptacle.

5. The spill proof container assembly recited in claim 4, wherein the collar includes at least one handle disposed on the exterior surface.

6. The spill proof container assembly recited in claim 5, wherein the collar includes a second integrated handle disposed at the exterior surface opposite from the first integrated handle.

7. The spill proof container assembly recited in claim 4, wherein the collar further comprises at least one recess adjacent to the inner wall that matingly receives a positioning tab disposed along a peripheral rim of the non-spill barrier.

8. The spill proof container assembly recited in claim 7, wherein the positioning tab is substantially flush with a flange on the collar creating a seamless surface between the non-spill barrier and the collar.

9. The spill proof container assembly recited in claim 1, wherein the cover snap fits onto the collar assembly.

10. The spill proof container assembly recited in claim 9, wherein the cover includes a pull tab that extends away from the peripheral edge of the cover.

11. A spill proof container assembly comprising: a receptacle having a closed end and an open end; a collar attached to the open end, the collar having a fastening loop on an outer wall, and an alignment recess adjacent to an inner wall; a non-spill barrier disposed underneath the collar and above the open end of the receptacle, the non-spill barrier has a positioning tab disposed along a peripheral rim that mates with the alignment recess in the collar; and a cover positioned over the collar, wherein the cover has an integrated hinge strap that extends from a peripheral edge and is adapted to be removably secured to the fastening loop, the hinge strap includes a first surface extending away from the peripheral edge, the first surface having a curved notch that separates a second surface, the first surface is bordered by a first rib and a second rib at opposite sides, located approximately at the intersection between where the curved notch ends and the second surface begins, the second surface has a raised bump adjacent to a free end, wherein when the hinge strap is being secured to the hook, the raised bump of the second surface passes through an opening in the hook until the hook is locked up against the first rib and second rib, and the raised bump, wherein when the hinge strap is secured to the hook, in a closed position, a back surface of the lid faces downward into the closed end of the receptacle and front surface faces outward and away from the closed end of the receptacle, wherein when the lid is opened, the back surface of the lid pivots adjacent to the hook radially open and away from the previous closed position of the back surface, in which the back surface was facing the closed end of the receptacle, outward along a rotation plane such that when the lid is in an open position, the back surface faces outward and radially away from the closed end and the receptacle, and wherein the hinge strap is rigid enough to prevent substantial twisting along an axial length of the strap disposed orthogonal to the pivot axis.

12. The spill proof container assembly recited in claim 11, wherein the positioning tab is substantially flush with a flange on the collar creating a seamless surface between the non-spill barrier and the collar.

13. The spill proof container assembly recited in claim 11, wherein the non-spill barrier has a plurality of curved openings extending outwards from a center towards the collar, wherein the curved openings have circular ribs at an end to provide extra reinforcement.

14. A spill proof container assembly comprising: a receptacle having a closed end and an open end; a collar having an alignment recess and a fastening loop attached to an outer surface; a resilient diaphragm with slot opening adapted to flexibly bend, the resilient diaphragm is disposed between the collar and the open end of the receptacle, the resilient diaphragm has a positioning tab disposed on a surface that mates with the alignment recess in the collar; and a cover having a hinge strap that extends from a peripheral edge, the cover adapted to be positioned over the collar, and the hinge strap being capable of being removably attached to the fastening loop, the hinge strap includes a first surface extending away from the peripheral edge, the first surface having a curved notch that separates a second surface, the hinge strap has a first rib and a second rib bordering edges of the hinge strap, and a raised bump a distance away that is approximately a width of a thickness of the fastening loop such that when the hinge strap is secured to the fastening loop, the width of the thickness of the fastening loop is secured by a friction fit between the first rib, the second rib, and the raised bump, wherein when the hinge strap is being secured to the hook, the raised bump of the second surface passes through an opening in the hook until the hook is locked up against the first rib and second rib, and the raised bump, wherein when the hinge strap is secured to the hook, in a closed position, a back surface of the lid faces downward into the closed end of the receptacle and front surface faces outward and away from the closed end of the receptacle, wherein when the lid is opened, the back surface of the lid pivots adjacent to the hook radially open and away from the previous closed position of the back surface, in which the back surface was facing the closed end of the receptacle, outward along a rotation plane such that when the lid is in an open position, the back surface faces outward and radially away from the closed end and the receptacle, and the front surface faces inward toward the receptacle, and wherein the hinge strap is rigid enough to prevent substantial twisting along an axial length of the strap disposed orthogonal to the pivot axis.

* * * * *